US012145794B2

(12) United States Patent
Peretti et al.

(10) Patent No.: US 12,145,794 B2
(45) Date of Patent: Nov. 19, 2024

(54) HINGE SYSTEM AND METHOD OF MANUFACTURE

(71) Applicant: The Dragon Group, LLC, Rathdrum, ID (US)

(72) Inventors: Todd J Peretti, Coeur d'Alene, ID (US); Scott Buffington, Spirit Lake, ID (US); Brandon Slack, Spirit Lake, ID (US); Raymond Lester, Liberty Lake, WA (US); Matt Nichols, Coeur d'Alene, ID (US)

(73) Assignee: The Dragon Group, LLC, Rathdrum, ID (US)

( * ) Notice: Subject to any disclaimer, the term of this patent is extended or adjusted under 35 U.S.C. 154(b) by 223 days.

(21) Appl. No.: 17/686,627

(22) Filed: Mar. 4, 2022

(65) Prior Publication Data

US 2022/0281678 A1 Sep. 8, 2022

Related U.S. Application Data

(60) Provisional application No. 63/156,594, filed on Mar. 4, 2021.

(51) Int. Cl.
*B65D 90/12* (2006.01)
*B65D 90/00* (2006.01)

(52) U.S. Cl.
CPC ..... *B65D 90/12* (2013.01)

(58) Field of Classification Search
CPC ..... B65D 90/12
USPC ..... 52/292
See application file for complete search history.

(56) References Cited

U.S. PATENT DOCUMENTS 1,465,784 A * 8/1923 Richardson ..... A47G 27/0218 160/229.1
1,614,127 A * 1/1927 Heppes ..... E04F 15/10 52/311.2
2,008,176 A * 7/1935 Fritsche ..... B65D 90/18 280/639
2,181,938 A * 12/1939 Fine ..... G09F 15/0075 52/301
2,194,653 A * 3/1940 Gell ..... A47G 27/0218 52/603
2,513,880 A * 7/1950 Lang ..... A47C 9/10 108/124
2,595,111 A * 4/1952 Steward ..... A47G 27/0481 24/703.1
2,855,966 A * 10/1958 Lewis ..... B65D 90/205 220/6
2,915,097 A * 12/1959 Lewis ..... B65D 90/205 220/666
3,782,063 A * 1/1974 Batorewicz ..... E04B 1/168 52/63

(Continued)

FOREIGN PATENT DOCUMENTS

DE 2637709 A * 2/1978 ..... B65D 90/12
EP 1277673 A1 * 1/2003 ..... B65D 88/524

(Continued)

*Primary Examiner* — Brian D Mattei
*Assistant Examiner* — Joseph J. Sadlon
(74) *Attorney, Agent, or Firm* — Chang & Hale LLP

(57) ABSTRACT

An exemplary pad for placement under a tank, for example, has first and second pad portions and a polymer hinge that allows the pad to be folded or closed.

20 Claims, 8 Drawing Sheets

(56) References Cited

U.S. PATENT DOCUMENTS 3,792,557 A * 2/1974 Pitts ..... E04B 1/3444 52/65
3,951,730 A * 4/1976 Wennberg ..... B65D 65/44 248/346.4
3,986,581 A * 10/1976 Caldwell ..... B65D 90/12 248/634
4,063,394 A * 12/1977 Feuerlein ..... E04H 7/14 52/294
4,118,901 A * 10/1978 Johnson ..... E04B 1/3445 52/18
4,156,492 A * 5/1979 Cavanna ..... F17C 13/083 220/560.1
4,361,995 A * 12/1982 Buck ..... E04C 2/405 52/631
4,512,120 A * 4/1985 Lindal ..... E04B 1/34321 52/143
4,527,362 A * 7/1985 Tobey ..... E04B 1/3441 52/646
4,603,658 A * 8/1986 Garnsey ..... A01K 1/033 119/499
4,649,675 A * 3/1987 Moldovan ..... E04H 3/00 52/27
4,811,681 A * 3/1989 Robishaw ..... B65D 90/0026 114/267
5,060,426 A * 10/1991 Jantzen ..... E04B 1/344 52/587.1
5,096,087 A * 3/1992 Thomas ..... B65D 90/501 220/627
5,237,784 A * 8/1993 Ros ..... E04B 1/34352 52/79.5
5,381,633 A * 1/1995 Hendrich ..... E04B 1/34807 52/745.11
5,382,113 A * 1/1995 Chilton ..... E02D 29/12 404/25
5,622,198 A * 4/1997 Elsinger ..... E04H 15/48 135/128
5,640,821 A * 6/1997 Koch ..... A47F 5/16 52/630
5,661,930 A * 9/1997 Porter ..... E04B 1/344 52/794.1
5,713,160 A * 2/1998 Heron ..... A01M 29/32 52/25
5,769,257 A * 6/1998 Fleisher ..... B64D 45/0061 109/1 R
5,806,270 A * 9/1998 Solano ..... E04F 15/02 52/749.11
5,971,009 A * 10/1999 Schuetz ..... B65D 90/30 137/341
6,058,660 A * 5/2000 Melton ..... E04H 6/04 52/36.5
6,088,969 A * 7/2000 Bigelow ..... E04B 1/34815 52/92.1
6,640,513 B2 * 11/2003 Ku ..... E04F 15/02 52/177
6,665,987 B2 * 12/2003 Eve ..... E04F 11/175 52/177
6,935,273 B2 * 8/2005 Throndsen ..... A01K 1/0157 119/431
6,938,383 B2 * 9/2005 Morris ..... E04B 1/26 52/302.1
7,334,369 B2 * 2/2008 Carson ..... E04D 13/076 52/11
7,650,923 B2 * 1/2010 Morris ..... B44C 1/10 160/327
8,474,639 B2 * 7/2013 Pinder ..... A47G 7/063 220/628
8,601,769 B2 * 12/2013 Amar ..... B32B 3/266 52/796.1
8,739,474 B2 * 6/2014 Chang ..... E04B 1/3449 52/79.5
8,814,110 B2 * 8/2014 Crager ..... B65D 19/0002 206/524.6
8,826,481 B1 * 9/2014 Haydu ..... E01D 19/005 404/69
9,016,653 B1 * 4/2015 Cox, Jr. ..... B65D 19/0002 52/292
9,079,708 B2 * 7/2015 Takai ..... E03F 1/002
9,103,111 B2 * 8/2015 Nakajima ..... E04B 1/3442
9,120,611 B2 * 9/2015 Ziegs ..... B65D 90/08
9,187,239 B2 * 11/2015 Buck ..... B65D 90/24
9,248,960 B2 * 2/2016 Avery ..... B65D 90/024
9,376,796 B2 * 6/2016 Ma ..... E04C 3/005
9,410,302 B2 * 8/2016 Perkins ..... B65D 90/24
9,555,959 B1 * 1/2017 Ziegs ..... B65D 88/005
9,862,538 B2 * 1/2018 Pham ..... B65D 88/32
9,908,692 B2 * 3/2018 Corbin ..... B65D 90/12
10,287,092 B2 * 5/2019 Daubert ..... B65D 90/046
10,442,616 B2 * 10/2019 Zhou ..... B60P 3/2295
10,538,384 B2 * 1/2020 Crowther ..... E04H 7/18
11,274,431 B2 * 3/2022 McCall ..... B27M 3/0053
11,746,543 B2 * 9/2023 Pierce ..... A47G 27/0268 52/717.03
2004/0007572 A1 * 1/2004 Payne ..... B65D 90/0073 220/1.5
2004/0123541 A1 * 7/2004 Jewett ..... E04B 1/98 52/506.01
2004/0134162 A1 * 7/2004 Douglas ..... E04B 1/12 52/741.1
2007/0125012 A1 * 6/2007 Quigley ..... A47B 95/043 52/167.1
2008/0047210 A1 * 2/2008 Bell ..... E04C 2/205 520/1
2008/0184660 A1 * 8/2008 Forner ..... E02D 31/00 52/309.1
2009/0056253 A1 * 3/2009 Davis ..... E02D 27/16 52/292
2010/0319270 A1 * 12/2010 Slade ..... B64G 1/222 52/71
2011/0203218 A1 * 8/2011 Solov ..... E01C 7/355 524/1
2011/0239577 A1 * 10/2011 Hansen ..... E04G 23/0207 52/514
2013/0284750 A1 * 10/2013 Takai ..... E03F 1/005 220/651
2014/0102023 A1 * 4/2014 Swarny ..... E02D 27/38 52/745.01
2014/0166665 A1 * 6/2014 McNamara ..... E03B 11/02 137/15.01
2014/0230348 A1 * 8/2014 Trudell ..... E04H 7/02 52/298
2014/0230352 A1 * 8/2014 Trudell ..... B65D 90/12 52/298
2016/0024837 A1 * 1/2016 Wachtell ..... B32B 27/065 52/309.14
2016/0177529 A1 * 6/2016 Devine ..... E02D 27/38 264/250
2020/0256048 A1 * 8/2020 Crowther ..... B65D 90/513
2022/0048705 A1 * 2/2022 Erm ..... B65D 88/121

FOREIGN PATENT DOCUMENTS

GB 2112441 A * 7/1983 ..... B65D 88/08
TN 2012000209 A1 * 12/2013 ..... A47G 27/0218

* cited by examiner

HINGE SYSTEM AND METHOD OF MANUFACTURE

PRIORITY CLAIM AND CROSS-REFERENCE TO RELATED APPLICATION

This application claims the benefit under 35 U.S.C. § 119(e)(1) of U.S. Provisional Application No. 63/156,594, filed Mar. 4, 2021, which is hereby incorporated by reference in its entirety.

BACKGROUND

Pads, such as pads placed underneath tanks, can be large in size. The pads can be unwieldy and not amenable to shipping, for example due to the size or shape of the pads. The transport of pads may be inefficient or impossible. In some cases, delivering pads to a location with containers, or moving pads from one part of a work site to another, may be prohibitively expensive or not feasible.

SUMMARY

This Summary is provided to introduce a selection of concepts in a simplified form that are further described below in the Detailed Description. This Summary is not intended to identify key features or essential features of the claimed subject matter, nor is it intended to be used as an aid in isolation to determine the scope of the claimed subject matter. Embodiments of the invention are not defined by this Summary.

In brief and at a high level this disclosure describes, among other things, a hinge system for a pad. For example, a pad can be split and then re-connected using a hinge system, which allows the pad to be closed or folded for transport and opened or flat for use. In some cases, a hinge is applied to two or more pad portions by preparing the pad portions with strips of material (such as strips of an adhesive or tape) along their top-facing, adjacent edges (the top of the inner-facing edges of each of the pad portions, where the pad portions are to be connected to each other), with a space between the strips of material where the pad portions touch, and spraying a material such as an elastomer (e.g., polyurea) over the adhesive to create a hinge between the pad portions. One or more materials sprayed, such as polyurea, can reach or penetrate the space between the strips of material and cover or seal the top of the inner-facing edge, forming a hinge. A pad with the hinge system, in embodiments, is robust and less expensive to ship, for example because a common carrier option may exist, without restrictions due to size.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

The subject matter of the present invention is described with specificity to meet statutory requirements. However, the description itself is not intended to limit the scope of this disclosure. Rather, the claimed or disclosed subject matter might also be embodied in other ways to include different components, steps, or combinations thereof similar to the ones described in this document, in conjunction with other present or future technologies. Terms should not be interpreted as implying any particular order among or between various steps disclosed herein unless and except when the order of individual steps is explicitly described.

For purposes of this disclosure, the word "including" has the same broad meaning as the word "comprising." In addition, words such as "a" and "an," unless otherwise indicated to the contrary, include the plural as well as the singular. Thus, for example, the constraint of "a feature" is satisfied where one or more features are present. Also, the term "or" includes the conjunctive, the disjunctive, and both (a or b thus includes either a or b, as well as a and b).

Various industries use tanks to contain materials including liquids, in some cases water or hazardous liquids. For example, tanks can provide storage above ground for various materials, for example liquids used by a farm to care for animals or used by a factory as raw materials. In other cases, tanks such as septic tanks can be used below ground. Some tanks are referred to as "poly" tanks, which may be made from, for example, polyethylene materials such as high density linear polyethylene (HDLPE) or high density cross-linked polyethylene (XLPE). In some cases the tanks are relatively lightweight and durable, and may be resistant to ultraviolet light. Such tanks may be constructed without seams to minimize leaks or damage that may compromise the tanks. Other storage containers besides tanks may be used to store materials, or empty tanks may be used at certain times.

Figure 1:
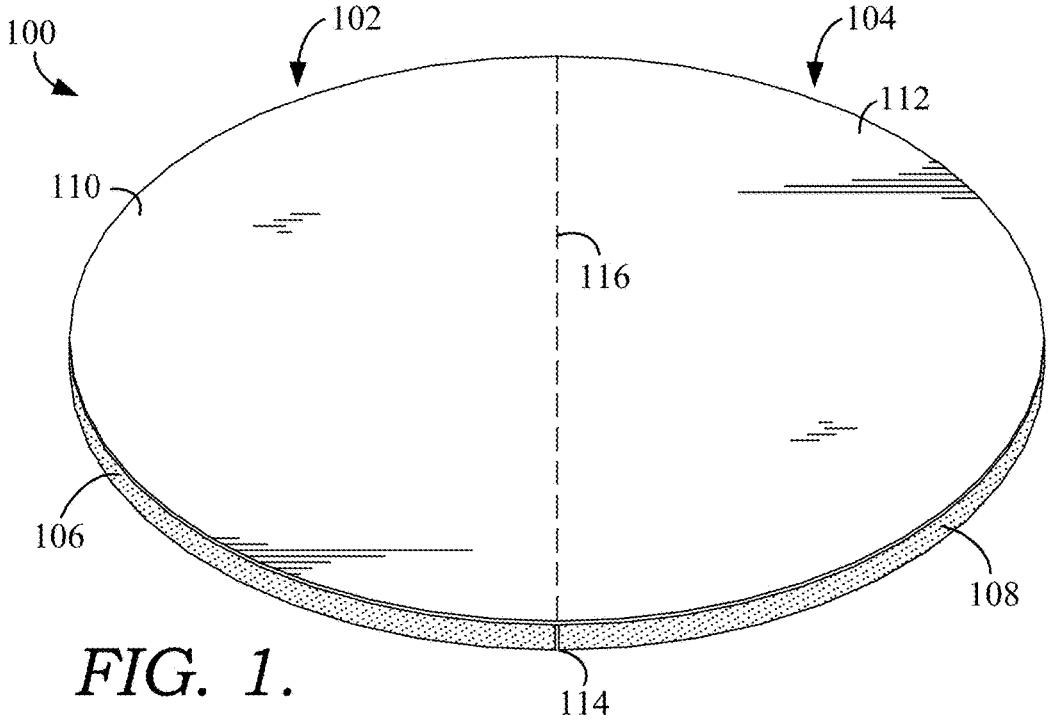
FIG. 1 is a perspective view of a support pad, in accordance with exemplary aspects hereof.

Tanks or other types of containers ("tanks") can be placed onto pads, padding, supports, pedestals, bases, platforms, etc. ("pad' and "pads") such as pad 100 shown in the drawings and discussed in more detail below. Tanks are placed onto pads 100, in embodiments, to reduce or prevent erosion of the bases of the tanks. Pads 100 can also provide a level, compact surface for stable placement of a tank. It can provide a layer of protection, for example in case material such as liquid affects the exterior of a tank, through use or leakage. Pads may also protect against objects or surface features puncturing or otherwise compromising a container. A pad 100 can be circular in overall shape (plan view), as shown in FIG. 1, or other shapes, such as square, with or without rounded corners, rectangular, oval (elliptical), or a custom or irregular shape, for example to accommodate a certain space or tank shape. Pads 100, in embodiments of the invention, can range in size, in some cases from approximately six to fourteen feet in diameter. In some cases a pad 100 can be smaller than six feet or larger than fourteen feet in diameter. In one example, a larger pad 100 can have dimensions of thirty-two by forty-eight feet. A pad 100 can have a planar level surface or a pad 100 can have a sloped surface in some examples.

Referring to FIG. 1, pad 100 is shown as one example of an embodiment of a "pad." Pad 100, in this example, is circular in shape when viewed from a top or overhead view. Pad 100 in FIG. 1 is shown in an open, or flat, position. In the embodiment illustrated, the pad 100 can be cut, split, divided, or severed into at least a first pad portion 102 and a second pad portion 104. In various embodiments, a pad 100 can be cut into additional portions (such as portions 102, 104) as well. The pad 100 can be cut into the pad portions (102, 104) using a saw or other conventional tools.

The severed pad portions (102, 104) retain the structure of the pad 100. The first pad portion 102 includes first padding 106 and the second pad portion 104 includes second padding 108. Additionally, in this embodiment, the first pad portion 102 includes a first top layer 110 and the second pad portion 104 includes a second top layer 112. As shown in the example in FIG. 1, the first top layer 110 is on top of, or is layered above or over (for example as a coating applied to), the first padding 106. Similarly, in this example, the second top layer 112 is on top of the second padding 108. In various embodiments, the pad 100 may be encapsulated with the material of the top layers (110, 112) (e.g., polyurea, or the like) or the material may be disposed on some but not all of the surfaces of the pad 100. Further, the pad 100 may be coated with the material of the top layers (110, 112) before dividing the pad 100 or after the pad 100 is fully assembled (with the hinge 126).

Figure 4:
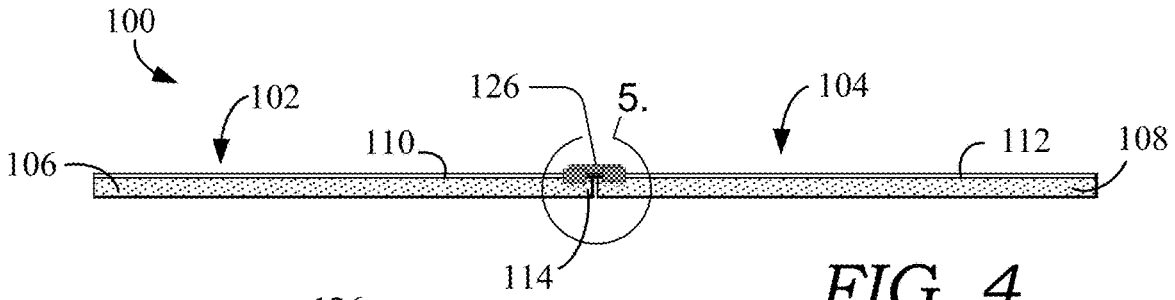
FIG. 4 is a cross-sectional view of a hinge system in accordance with exemplary aspects hereof.
Figure 5:
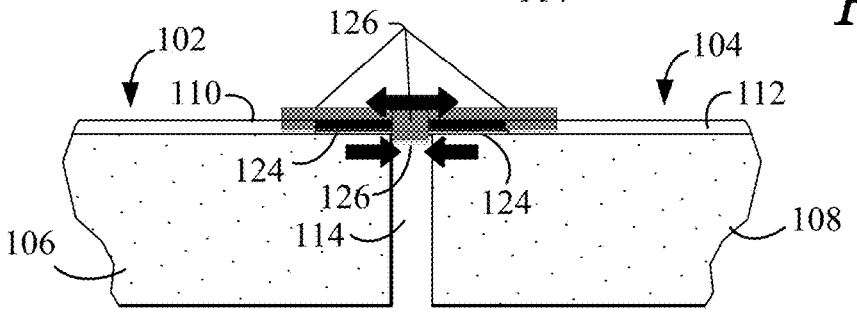
FIG. 5 is a magnified cross-sectional view of the encircled region 5 of FIG. 4 of a hinge system in accordance with exemplary aspects hereof.
Figure 6:
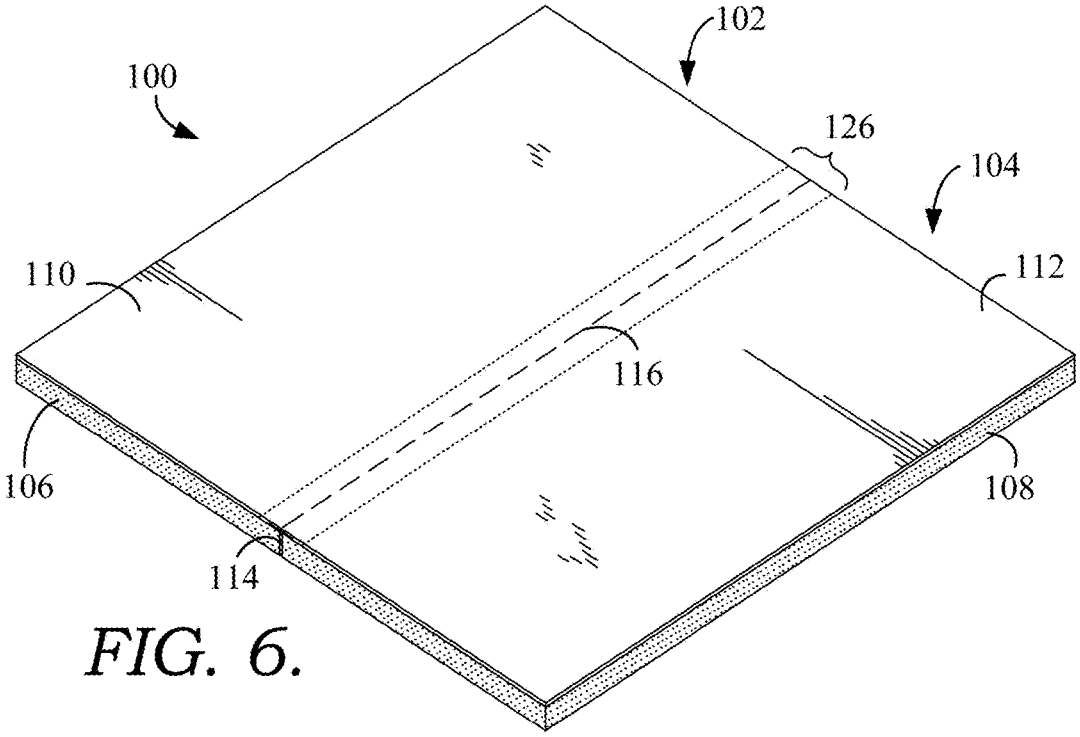
FIG. 6 is a perspective view of a pad with a hinge, in accordance with exemplary aspects hereof.

In the example of FIG. 1, the pad 100 is circular in shape, so the first pad portion 102 and the second pad portion 104, in this example, are each semi-circle in shape. In other embodiments, the pad portions 102 and 104 may have other shapes, which may be the same or similar shapes or the pad portions 102 and 104 may have different shapes. For instance, the pad 100 in the example shown in FIGS. 4-6 are rectangular.

The first pad portion 102 and the second pad portion 104 are arranged next to each other and aligned and abutted to each other, such that at least one edge of first pad portion 102 (e.g., the severed edge, for example) is abutted to at least one edge of the second pad portion 104 (e.g., the corresponding severed edge, for example), forming a joint 114. In the illustration of FIG. 1, line 116 is shown to represent a diameter across the pad 100, and also indicates the division between the first pad portion 102 and the second pad portion 104 at the joint 114 where they meet. For instance, each pad portion (102, 104) has one edge aligned along the line 116, as shown in FIG. 1. The first pad portion 102 extends laterally in one direction from line 116, outward, towards an outer edge of the first pad portion 102. The second pad portion 104 extends laterally in the opposite direction from line 116, in this example, outward towards an outer edge of the second pad portion 104. A pad 100 has a planar surface comprising the top surfaces 110, 112 that meet seamlessly at the joint 114, along line 116.

In various embodiments, an additional pad portion (same or similar to the first and second portions (102, 104)) can be aligned with and abutted to at least one edge of either the first portion 102 or the second portion 104. Other portions may also be added in a like manner. This way the pad 100 can be extended laterally to have any dimension desired (by adding a quantity of pad portions in sequence). In some cases, with polygonal shaped portions, for example, the one or more additional portions may be aligned with one edge of both the first portion 102 and the second portion 104. In an alternative embodiment, the additional pad portion may be manufactured separately to have the characteristics of a pad portion (102, 104), rather than being severed from a whole pad 100.

Figure 7:
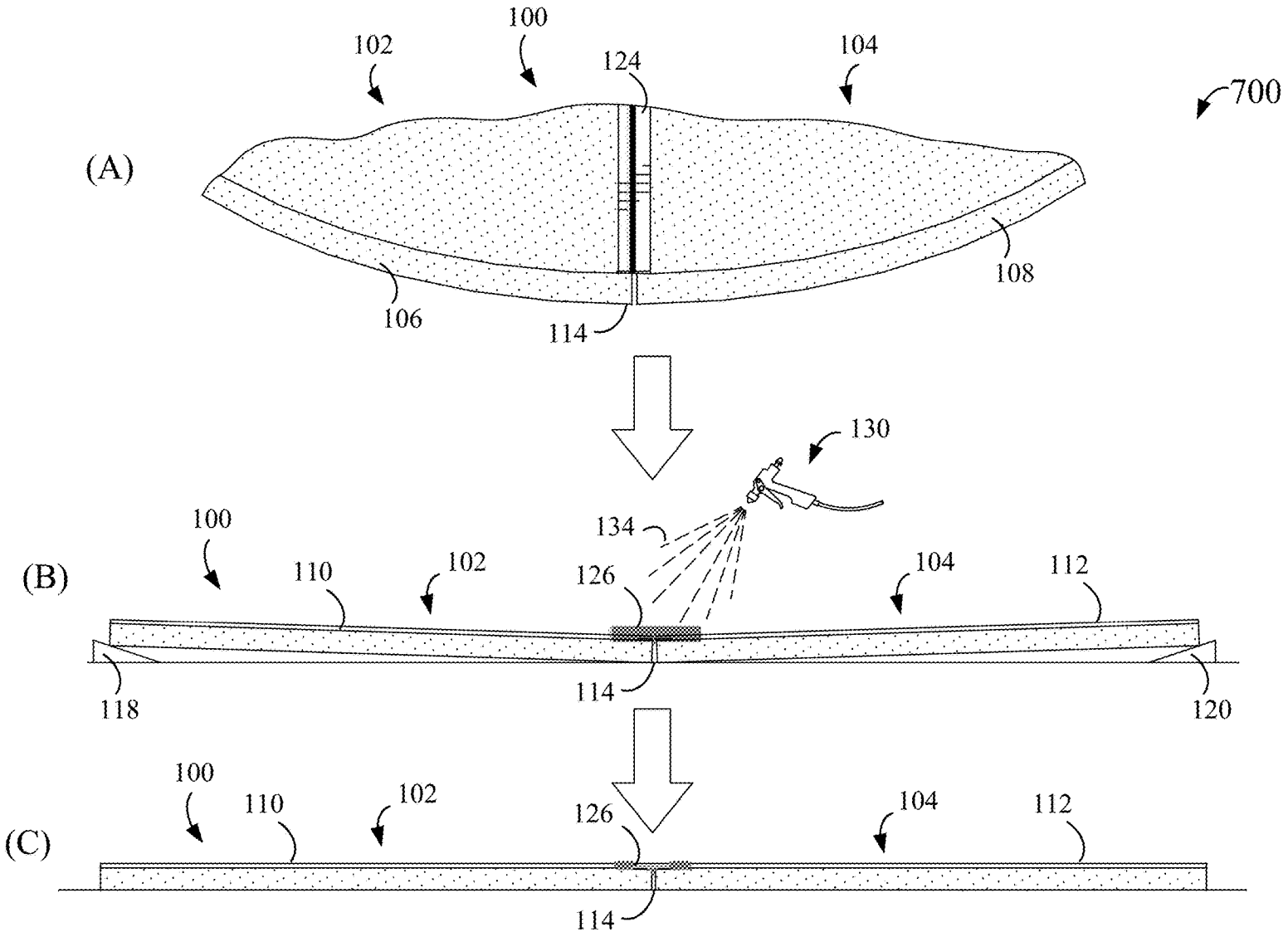
FIG. 7 depicts a sequence including a partial top view of portions of a pad, a perspective view of the application of aspects of an embodiment of a hinge system, and a perspective view of an pad in accordance with exemplary aspects hereof.

First padding 106 and second padding 108, in embodiments, can be comprised of foam or any cushioned or absorbent material, including plastic or polymer-based compounds that may be designed to be lightweight and/or resistant to damage related to chemicals, liquid, or erosion. First top layer 110 and second top layer 112, in embodiments, can be constructed of any material that can be affixed or applied as top layer to first and second padding 106, 108. For example, an elastomer material such as polyurea, or a like material, can be employed as the first top layer 110 and/or the second top layer 112, applied to the top of each pad portion (e.g., first and second pad portions 102, 104). In some cases, first and second top layer 110, 112 may be applied as part of hinge 126 (for example when material 134 is sprayed onto pad 100, as shown in FIG. 7, discussed below).

First and second top layers 110, 112 can be applied via a machine or manufacturing process, by manual application including spraying or spreading the material, or by other processes, such as three-dimensionally printing one or more pad portions to include or be comprised of padding and/or a top layer (such as first padding 106 and/or first top layer 110). In some cases, materials comprising a first pad portion 102 may be combined, activated, molded, or otherwise treated to create a top layer such as first top layer 110.

Figure 2:
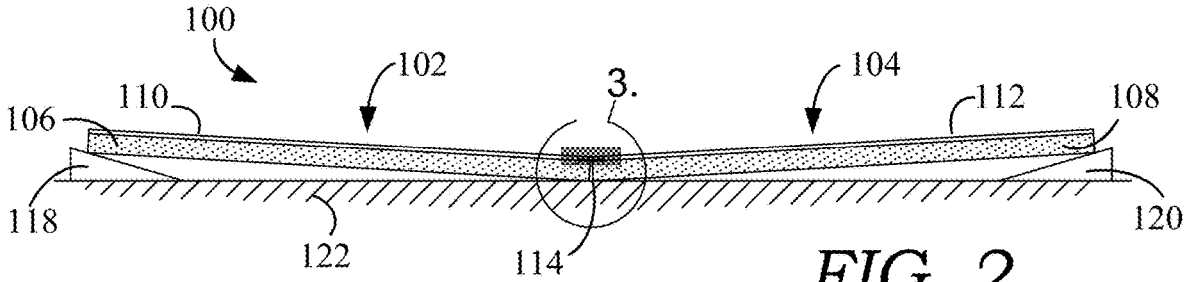
FIG. 2 is a cross-sectional view of a hinge system in accordance with exemplary aspects hereof.

Turning to FIG. 2, a cross-section of an example pad 100 is shown, according to some embodiments. As shown, first padding 106 makes up a lower or bottom layer of first pad portion 102, underneath a first top layer 110. The example pad 100, including the first and second portions (102, 104) can be positioned for forming a hinge 126 over the joint 114 between the portions 102 and 104. For example, an outer edge of first pad portion 102 can be arranged so that part of first padding 106 is resting partially or completely on a first wedge 118, as shown in FIG. 2. Also as shown in the embodiment in FIG. 2, the outer edge of second pad portion 104 can optionally be placed with second padding 108 resting on a second wedge 120. First wedge 118 and second wedge 120 are made from wood in some embodiments, or they can be constructed of other materials such as metal or plastic, etc.

In some cases, instead of a wedge (118, 120), a block or another shape is used to elevate the outer edges of at least one of the first pad portion 102 and second pad portion 104. In embodiments, first wedge 118 and second wedge 120 are circular or another shape with a slope to create a wedge-shaped cross-section. In some exemplary embodiments, a built-in wedge, raised portion, or ring of material could be provided, and first pad portion 102 and second pad portion 104 could be placed into a particular area, causing the outer edges of each pad portion to be raised slightly. Wedges (118, 120) or other objects or features of a manufacturing environment, can be used to raise one or both of the first pad portion 102 and the second pad portion 104, creating a slight "V"-shape of the two pad portions when viewed as a cross-section (or from a side view), with a vertex of the "V"-shape along line 116, as illustrated at FIG. 2. In embodiments, a surface 122 is disposed underneath pad 100, for example when pad 100 is in a slight "V"-shape as shown in the cross-sectional view in FIG. 2. It some cases, the surface 122 can include at least one first and second wedges 118, 120, or a ring or partial ring of raised features or material, as part of surface 122, allowing pad 100 to be placed in a "V"-shape.

The "V"-shape shown in FIG. 2 illustrates an embodiment. In various embodiments, the "V"-shape could be narrower or wider (more or less of an obtuse angle). In an implementation, the "V"-shape may be 90 degrees (an "L"-shape) or an acute angle. Alternately, the "V"-shape can comprise at least 180 degrees. As illustrated in FIG. 2, the top edges of first pad portion 102 and second pad portion 104 are touching (in contact) along the top of joint 114, in embodiments, when pad 100 is in a "V"-shape. The top edges of first and second pad portions 102, 104 can be comprised of first and second top layers 110, 112, respectively, in embodiments, or the top edges can be comprised of the top edges of first and second padding 106, 108, in embodiments, or a combination or both.

Figure 3:
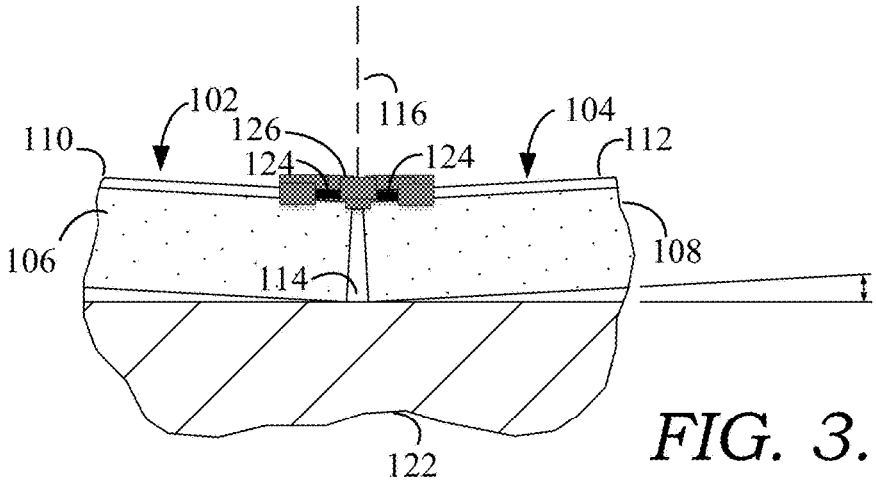
FIG. 3 is a magnified cross-sectional view of a portion of a hinge system in accordance with exemplary aspects hereof.

Turning to FIG. 3, a magnified view of the section indicated by the numeral "3" in FIG. 2 is shown. First pad portion 102 is shown on the left side of FIG. 3, while second pad portion 104 is shown on the right side of FIG. 3. Line 116 is shown in between first pad portion 102 and second pad portion 104. FIG. 3 shows an illustrative joint 114 in one embodiment, which can be widened at the bottom by placing at least one of first pad portion 102 on wedge 118 and second pad portion 104 on wedge 120, or otherwise arranging the first and second pad portions (102, 104) in a "V"-shape, as described above. The first and second pad portions 102, 104 are touching above joint 114, with joint 114 becoming wider as it extends downwardly towards surface 122, which is supporting the pad 100 in this illustration.

As shown in FIG. 3, to prepare to form a hinge 126, an adhesive 124 can be applied over first padding 106 and second padding 108. Adhesive 124 can be applied in one or two strips or lines, at the line 116 or on either side of and directly adjacent to where first padding 106 and second padding 108 touch or align along their top edges (line 116). In embodiments, joint 114 is closed or nearly non-existent (at its smallest) near the top of pad 100. The adhesive 124 is applied along the center of and to either side of line 116, across the top surface of pad 100 (on top of first top layer 110 and second top layer 112, if used). In some cases, first and second top layers 110, 112 have been applied separately, and adhesive 124 is applied along the center of and/or to either side of line 116 and extending outwardly from each side of line 116 to create one or more bands or stripes of adhesive 124, for instance two stripes of adhesive 124 that straddle line 116 and are disposed on the first pad portion 102 and the second pad portion 104, as shown in FIG. 3. A hinge 126 is formed by depositing hinge material 134 that spans across the first portion 102 and the second portion 104, coupling the portions (102, 104) with the hinge material 134.

In some cases, the first and second top layers 110, 112, or additional portions of these layers, are applied after an adhesive 124 has been applied along line 116 across the top surface of pad 100. In other cases, adhesive 124 can be removed after application of a hinge material 134 on top of adhesive 124 that creates a hinge 126 coupling the first pad portion 102 to the second pad portion 104. Adhesive 124 can be any material, such as plastic or tape (for example, duct tape), silicone sheets or strips, or strips or pieces of acrylonitrile butadiene styrene (ABS) or the like. In embodiments, an adhesive 124 may be duct tape having a top surface that will not stick to a sprayed or applied material (such as material 134, discussed with respect to FIG. 7, below). In alternative embodiments, strips or sections of material without an adhesive characteristic may be used as the adhesive 124. For instance, a section of a silicone material (or a like material that resists adherence to the hinge material 134) can be positioned at the joint 114, where the section of material conforms to the joint 114, filling the joint 114 while the hinge material (134) is being applied, as discussed further below.

In embodiments, the hinge 126 is applied above (i.e., over, on top of) adhesive 124, as shown in FIG. 3. In embodiments where the adhesive 124 is omitted, the hinge 126 can be applied on top of the first top layer 110 and the second top layer 112, for example by spraying or otherwise applying the hinge 126 along line 116 on top of pad 100. In some cases, hinge 126 could be three-dimensionally printed or otherwise manufactured and applied (with or without heat) to the top of pad 100. Hinge 126 can comprise a layer of elastomer material 134 such as polyurea, or a mixture or solution containing two or more components including polyurea, in embodiments, which can be sprayed in one or more layers onto pad 100 along line 116, on top of and between strips of adhesive 124 (or over the sections of silicone (or like) material discussed above), which can then be removed, leaving the hinge 126 (as discussed below with respect to FIG. 7).

In some cases, more than one layer of hinge material 134 is sprayed onto pad 100 to create hinge 126. Each layer may be allowed to dry, or more layers can be applied during the same manufacturing step without allowing for materials to dry or set. In embodiments, hinge 126 is sprayed or applied across the entire top of pad 100 (essentially covering or layering over top layer 110 and top layer 112), but (in some examples) with more layers or applications or treatment along line 116. Hinge 126 can be comprised of polyurethane or another material that can be applied as a spray and provide a hinge 126 at the first and second pad portions 102, 104.

Hinge 126 can be layered or otherwise applied onto pad 100, with hinge 126 covering the joint 114 along line 116 such that the hinge 126 extends laterally from line 116 onto part (or all) of the first pad portion 102 and/or the second pad portion 104. Hinge 126 may not be easily discernable or visible when pad 100 is viewed from the top (such as the views shown in FIG. 1), and hinge 126 may not be easily discernable or visible when pad 100 is viewed from the side or in a cross-sectional view, because hinge 126 may not add any substantial thickness to pad 100. The hinge 126 may be applied in an even layer or blended to the first and second top layers 110, 112 in some cases. In embodiments, the hinge 126 may be detectable as one or more layers of additional material, or one or more layers of distinct material, applied to pad 100 along one or more lines, such as line 116.

In the various embodiments, the hinge 126 is flexible. For instance, the hinge material 134 can be flexible when set. Thus, the hinge 126 can allow for pad 100 to be folded in half, with the first pad portion 102 over or on top of the second pad portion 104, in a more compact formation. Hinge 126 can also allow for partial folding, such as placing pad 100 into an "L"-shape with an approximately ninety degree angle at line 116, which could also increase shipping options or allow for easier or cheaper transport at a work site. Hinge 126 allows pad 100, in embodiments, to be opened up or flattened for use, at a wider diameter or larger size, with hinge 126 taut or in tension or otherwise enabling pad 100 to be flat and act as one pad. Once the hinge 126 is formed, the first pad portion 102 is inseparable from the second pad portion 104.

When pad 100 is open for use with hinge 126 flattened along line 116, first padding portion 106 and second padding portion 108 can be aligned and, in some cases, in contact along line 116, eliminating most or all of any gap in joint 114, thereby providing a stable pad 100 of a large size for use underneath a tank, for example. Further, once deployed, any gap in the joint 114 can be sealed using a gasket, caulking, or other technique. Accordingly, the pad 100 is not intended to remain divided, but is sealed as a single unit pad 100 on deployment. Thus, hinge 126 can allow the pad 100 to be folded during shipping or transport or storage, and opened when deployed. Pad 100 can provide a wide and/or flat surface (across the top of pad 100, above top layers 110, 112 and hinge 126) for placement of one or more tanks, in examples. Additionally, the hinge 126 couples the first pad portion 102 to the second pad portion 104 and forms a continuous moisture barrier between the first portion 102 and the second portion 104. In other words, the hinge 126, the top surface 110 of the first portion 102, and the top surface 112 of the second portion 104 comprise a planar, moisture-sealed surface.

The application of adhesive 124, such as a material or tape, on the first and second pad portions 102, 104 can limit the size of the hinge 126 by limiting the area sprayed with hinge material(s) 134 (such as polyurea or a mixture containing polyurea, in embodiments). In one example, two strips of adhesive 124 (e.g., duct tape, etc. as described above) are used to outline a narrow stripe on the surface of the first and second pad portions 102, 104 centered on the line 116. The hinge material 134 is sprayed in a band over the pad portions (102, 104), with a limited width and/or a limited amount of material 134 being applied. This can provide a hinge 126 with increased flexibility for a pad 100 that is easier or more efficient to fold. Because adhesive 124 limits the area and/or amount of material that is applied to the first and second pad portions 110, 112, for example, the process allows freedom of movement of hinge 126 along line 116, where first and second pad portions 110, 112 meet, so that the pad 100 can fold more effectively. In some cases, if a material is applied to a wider area (that is not limited by adhesive 124), the hinge 126 may be too wide and/or stiff to allow for effective folding.

In embodiments, three or more pad portions (e.g., 102, 104) can be used, in some cases with two or more hinges, such as hinge 126, within one pad 100. For example, if a circular or rectangular pad has three or more portions, they can be aligned and treated with the processes described herein to create two or more hinges within one pad 100, enabling pad 100 to be folded or closed along more than one line, for example, with two outer or side portions both folded over a center portion, so that a folded pad 100 is approximately one-third of the width of the overall pad 100. In other embodiments, smaller squares or portions of a larger pad 100 can be folded using hinges such as a hinge 126, to allow multiple portions of a pad 100 to be folded onto each other and essentially stacked while still attached to each other. In some cases, each hinge 126 is in tension when the pad 100 is fully open and flat for use.

Turning now to FIG. 4, another embodiment of pad 100 is illustrated. Pad 100, as discussed above, can be any shape, for example here a square shape (in plan view). Pad 100 in FIG. 4 is split into first pad portion 102 and second pad portion 104, which can include first padding 106 and second padding 108, respectively. First pad portion 102 also includes first top layer 110, and second pad portion 104 includes second top layer 112, in embodiments. A joint 114 is illustrated in the cross-sectional view of FIG. 4 and extends below the hinge 126 of pad 100 from one edge to another (along line 116 as shown in FIG. 6, for example). Joint 114 comprises the division between first padding 106 and second padding 108, without comprising an actual gap or air, and joint 114 can even comprise an airtight seal between the first pad portion 102 and the second pad portion 104.

As shown in FIG. 5, the joint 114 is illustrated larger than scale for discussion purposes. In embodiments, the slack of joint 114 can be adjusted, for example by moving first padding 106 and second padding 108 towards or away from each other, as shown in FIG. 5, to provide a smaller or larger space for the hinge 126 to operate as desired. In other words, the joint 114 provides a location for the hinge 126 to operate when the pad 100 is folded, but is not present when the pad 100 is laid flat (such as in a deployed state). When deployed, the joint 114 is not present on the top surface (110, 112) of the pad 100 because the hinge 126 covers over the joint 114. The joint 114 may not be present on the side edges if the joint 114 is sealed or caulked. During manufacturing, the first and second pad portions 102, 104 can be pressed together tightly and/or sealed. Further, when the hinge material 134 cures, in some cases the hinge material 134 shrinks, contracts, or otherwise can pull the first and second pad portions (102, 104) closer together. For instance the hinge material 134 may shrink approximately 2% upon curing in some cases.

FIG. 6 shows an exemplary pad 100 from a top view, with first pad portion 102 and second pad portion 104. In FIG. 6, first pad portion 102 is a rectangular portion, as is second pad portion 104. First pad portion 102 abuts second pad portion 104 at line 116, creating joint 114 between the first and second pad portions 102, 104. Joint 114 may not include a gap, in embodiments, but may mark the transition from one pad portion to another. From a top view such as that shown in FIG. 6, line 116 indicates where a hinge 126 has been applied.

Line 116 may be indicated in some fashion, by markings on the top or sides of pad 100, or by extensions or handles (not shown) placed on either side of joint 114, perpendicular to line 116, so that users can identify and handle the first and second pad portions 102, 104 in a manner that uses the hinge 126 to secure the first and second pad portions 102, 104 while pad 100 is in a folded or partially folded or closed position, while allowing the first and second pad portions 102, 104 to be unfolded or opened and to act as one pad 100. Hinge 126 can be stretched or in tension when pad 100 is completely opened or flat, in some cases keeping the joint or connection between first and second pad portions 102, 104 flat. In some cases hinge 126 can aid in or cause the first and second pad portions 102, 104 to be pulled together or held together. This aid and tension can be increased when the hinge 126 is formed by applying the hinge material 134 while the first and second pad portions (102, 104) are arranged in the "V"-shape. Once the hinge material 134 has cured, laying the pad portions (102, 104) flat puts tension on the hinge 126. Additional tension can also be formed if the hinge material 134 shrinks or contracts as it cures.

In some embodiments, extensions or handles on the edges of pad 100 (on either side of joint 114, one two opposite edges of pad 100) can be used to "snap" or lock pad 100 into a flat or open position, and/or they may be used to fold ("close") the pad 100 along the hinge 126.

Turning to FIG. 7, selected and exemplary steps of a process 700 for applying a hinge system in accordance with embodiments of the present invention are illustrated. In FIG. 7 at (A), the pad 100 is shown severed, with the first pad portion 102 and the second pad portion 104 aligned and abutted to each other. The joint 114 between the first and second pad portions (102, 104) does not include a gap. The first pad portion 102 is flush with the second pad portion 104, such that first padding 106 is touching or at least partially in contact with second padding 108 along joint 114, which is merely the dividing line between the first and second padding 106, 108. As shown at (A), an adhesive 124 can been applied above joint 114, across the length or diameter of pad 100 (a portion of which is illustrated in FIG. 7).

At (B), an applicator 130 is used to spray hinge material 134 onto pad 100, which can be sprayed in an approximate line across pad 100, above the adhesive 124, while the first and second pad portions 102, 104 are arranged in a slight "V"-shape (in some embodiments), such that the joint 114 is wider at the bottom and narrowest or imperceptible at the top near adhesive 124. In some cases, hinge material 134 is sprayed in one or more layers in a wide band, to cover adhesive 124, including layers that are one or more inches (in some cases several inches) wider than adhesive 124, to overlap top surfaces 110 and 112. In other embodiments, hinge material 134 is sprayed across the entire top of pad 100, or nearly the entire top, over top surfaces 110 and 112, but may be concentrated or applied in one or more additional layers in a band or area above (and around) adhesive 124. The hinge material 134 may be allowed to dry and cure while pad 100 is in a "V"-shape formation, in some cases. As shown at (C), the pad 100 can then be deployed flat or open, with joint 114 covered by hinge material 134 to create a hinge 126. The hinge 126 may not be visible from the top surface but can allow pad 100 to be folded or arranged into an "L"- or "V"-shape as desired.

In an alternate process, the hinge material 134 can be sprayed to form the hinge 126 while the first and second pad portions 102, 104 are flat, rather than arranged in a "V"-shape. The alternate process may include providing a sufficient joint 114 between the first and second pad portions 102, 104 to allow for a hinge 126 to be formed and functionally operate as a hinge considering the thickness of the first and second pad portions 102, 104. A jig or a spacer (or the like) can be used to space the first and second pad portions 102, 104 as desired for functional operation of the hinge 126, as described further below.

As shown at (C), adhesive 124 can be removed from beneath the hinge 126, for example after hinge 126 has dried and/or cured. In embodiments, the adhesive 124 can prevent hinge 126 from adhering to areas of the first and second top layers 110, 112 near the joint 114, which can to allow freedom or greater freedom in hinge 126 for operation. The area created by the adhesive 124 (for instance when arranged in a single strip down the line 116 or in two strips or pieces along either side of line 116) allows hinge 126 to form without attaching or without rigidly attaching to either top layer directly at the line 116. In some cases, the hinge 126 can attach to the top of the first padding 106 and the second padding 108 where they meet, without attaching to the top surfaces 110 and 112 at the line 116. In other embodiments, the edges of first and second top layers 110, 112 may be connected via hinge 126, but only a minor or exposed amount of first and second top layers 110, 112 may have hinge 126 applied, due to adhesive 124. In yet other embodiments, only the inside edges (the inner-facing edges) of first and second top layers 110, 112 may be connected via hinge 126.

Figure 8:
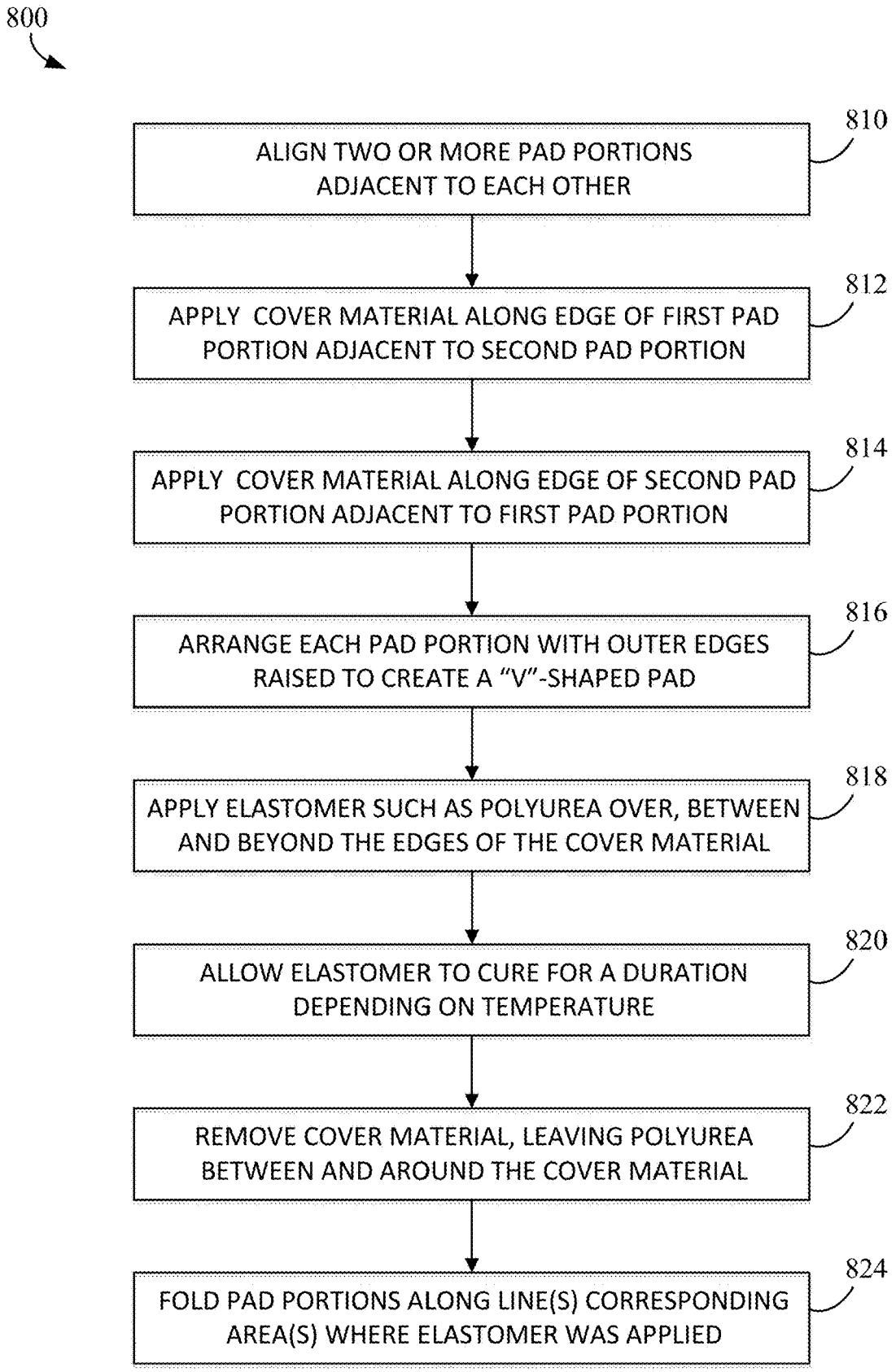
FIG. 8 shows a flow diagram including one or more processes relating to a hinge system, in accordance with exemplary aspects hereof.

FIG. 8 is a textual flow diagram of one or more processes 800 relating to embodiments of the present invention. For example, as shown in FIG. 8, a pad 100 including hinge 126 can be made, in embodiments, in accordance with one or more exemplary steps. Initially, a manufactured pad 100 is split into 2 or more portions. As shown at 810, one or more pad portions (such as first and second pad portions 102, 104) are aligned and abut each other. In embodiments, three or more pad portions may be aligned or arranged in order to enable hinge systems in accordance with embodiments herein. At 812, a cover material is applied along an edge of the first pad portion (such as first pad portion 102), where the cover material can be applied in a strip or line along an edge of the pad portion that is aligned next to the other pad portion, in embodiments. In some cases, the cover material can be adhesive 124, which can be any tape or plastic material, for example, that can be applied (and then removed after application of a hinge 126). Cover material can include a silicone (or like material) spacer, or other cover that tends to not adhere to the material 134. At 814, another cover material is applied along the edge of the second pad portion, such that both cover materials are applied to edges of pad portions and both cover materials are also aligned along the edges of the pad portions, adjacent to each other (for example as shown by the adhesive 124 on first and second pad portions 102, 104 in FIG. 5). In an alternate embodiment, a single cover material can be applied to both pad portions (102, 104), taking the place of separate cover materials for each pad portion (102, 104).

At 816, one or both pad portions 102, 104 (e.g., first pad portion 102) is elevated at the outer edge slightly (at the edge opposite from the cover material), so that the pad overall has a slight "V" shape when viewed from the side or in a cross-sectional view, such as in FIGS. 2 and 3. At 818, an elastomer such as polyurea or a polyurea compound (i.e., hinge material 134) is applied over the cover material and in the space between the cover material (where the pad portions are abutted), thereby forming a hinge, such as hinge 126, between the pad portions 102, 104. At 820, the hinge material 134 is allowed to cure. For example, in some cases the hinge material 134 cures for about 12 hours or, in some cases depending on temperature, less than 12 hours or for up to 72 hours or more.

At 822, the cover material is removed. Any combination of the processes described herein can be combined or omitted in the course of producing embodiments of the present invention, including this step, which may be omitted. At 824, a pad such as pad 100, which has had a hinge material applied (such as polyurea sprayed in between strips of adhesive), can be folded along one or more lines (such as line 116, for example) that correspond to one or more joints 114 that are connected by hinge 126.

Figure 9:
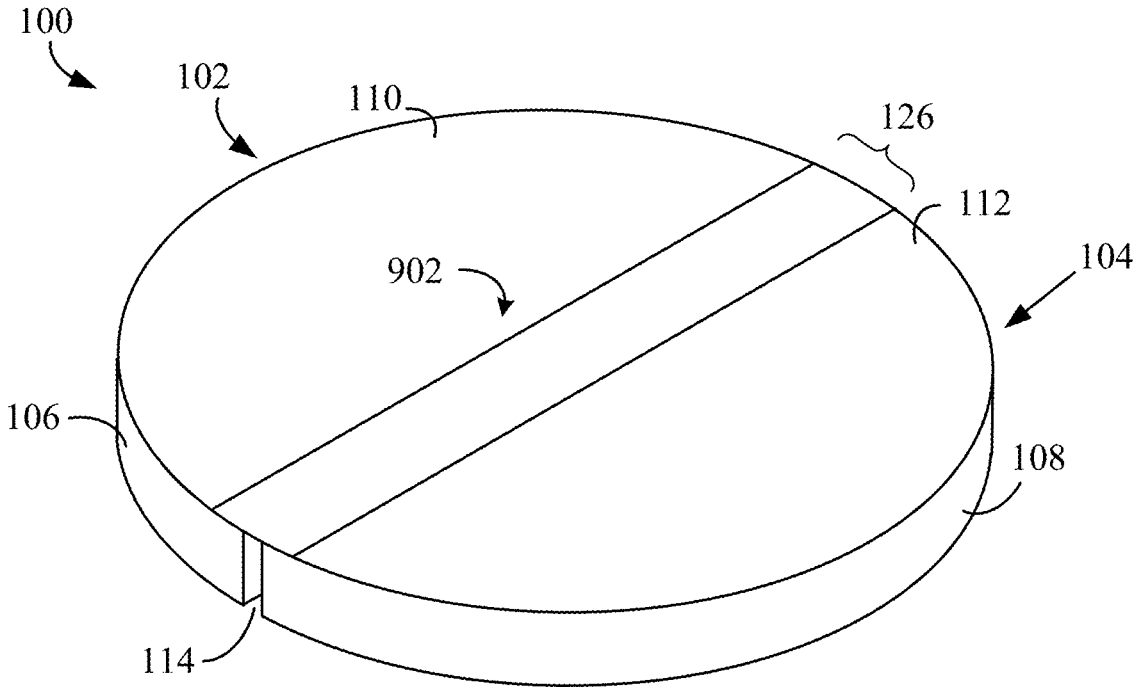
FIG. 9 is a perspective view of a pad with a hinge, in accordance with exemplary aspects hereof.
Figure 10:
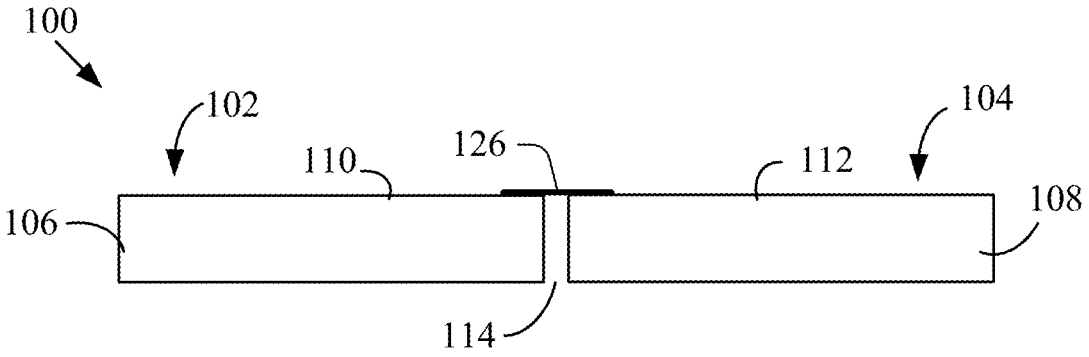
FIG. 10 is a cross-sectional view of a hinge system in accordance with exemplary aspects hereof.

Alternate embodiments of a hinged pad 100 and corresponding process steps for manufacture are discussed with reference to FIGS. 9-15. Referring to FIGS. 9 and 10, in some embodiments, the hinge 126 can comprise a layer of cured hinge material 134 as discussed above. Alternately, the hinge 126 can comprise any flexible robust material that is suitable for application to a pad 100, for example various polymers, elastomers, composites, and the like, which may be combined as desired. After the pad 100 is formed and split into pad portions 102, 104 as discussed above, including top layers 110 and 112 when present, the pad portions 102, 104 are arranged adjacent to each other and abutted against each other with a joint 114 between them. (Note that joint 114 is enlarged in FIGS. 9 and 10 for convenience of discussion. Actual joint 114 may be imperceptible.) In the implementation, the pad 100 is formed as a unit (including padding 106, 108 and top layers 110, 112 when present), and then cut or severed into two or more pad portions 102 and 104 prior to forming the hinge(s) 126. Alternately, one or more pad portions may be formed independently, particularly when more than two pad portions are used to form the pad 100.

After abutting the pad portions 102, 104 (at the respective severed edges, for example), a hinge 126 can be formed over the joint 114 between the pad portions 102, 104 or a pre-formed hinge 126 can be positioned over the joint 114 between the pad portions 102, 104. In either case, the hinge 126 may be disposed to partly overlap each pad portion (102, 104). One or more sealing coats 902, which can comprise one or more layers of top layer (110, 112) materials (or any other suitable material, e.g., polymer, elastomer, etc.), can be applied (e.g., sprayed, coated, painted, etc.) over the hinge 126, to seal the hinge 126 in place. The one or more sealing coats 902 are also applied over some or all of each of the pad portions (102, 104), and may cover the entire pad 100, in some examples. Because the sealing coat(s) 902 can comprise the same materials as the top layers (110, 112), and in some cases the same materials as the hinge 126, the sealing coat(s) 902 may not be perceptible once cured.

Referring to FIGS. 11-14, in some embodiments, a jig 1102 may be used to aid in the formation of a hinge 126. For example, when the pad portions 102, 104 are positioned adjacent to each other, a jig 1102 may be used as a spacer to provide the joint 114 desired for the operation of the hinge 126. In various examples, the jig 1102 is positioned between the first and second pad portions (102, 104), and the pad portions (102, 104) are tightly pressed against the jig 1102. The jig 1102 may be the length of the diameter of the pad 100, or it may be greater or lesser in length. The jig 1102, which may have a thickness of no more than ⅛ inch in some examples, holds the pad portions (102, 104) a predetermined distance apart while the hinge 126 is formed.

Figure 11:
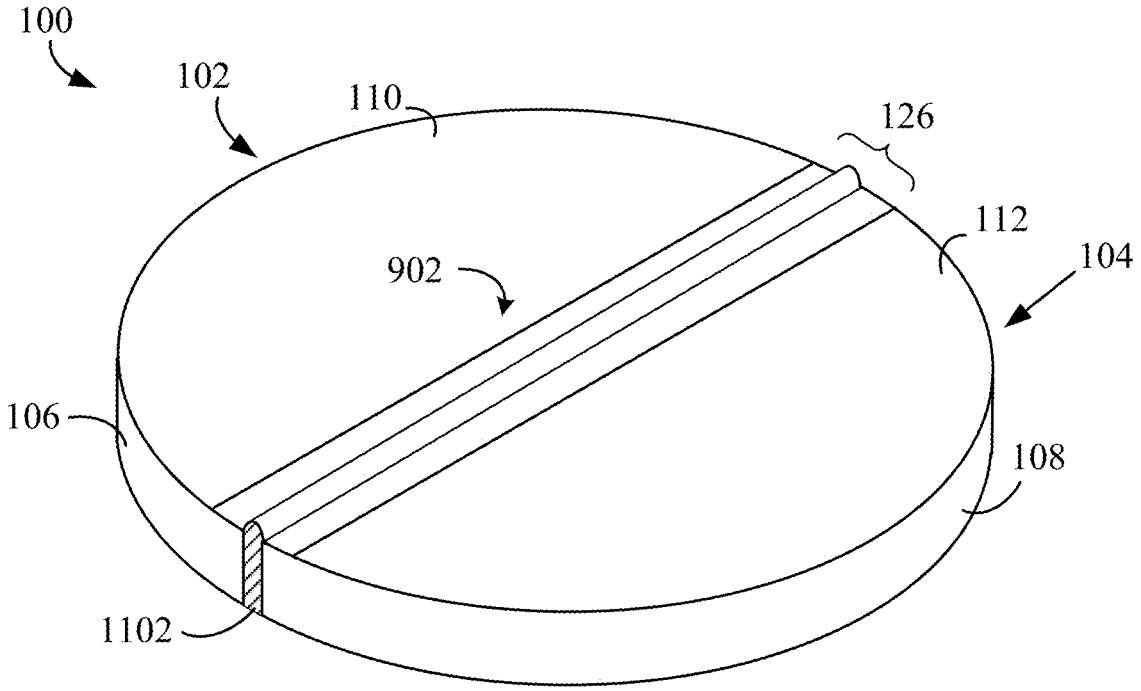
FIG. 11 is a perspective view of a pad with a hinge, in accordance with exemplary aspects hereof.
Figure 12:
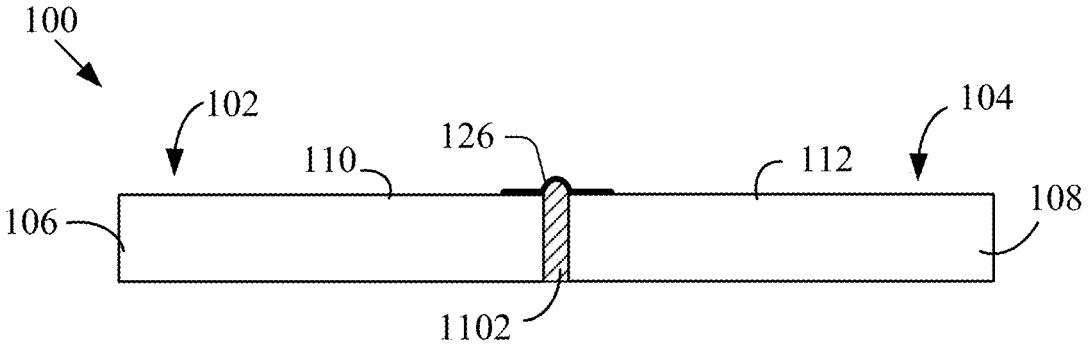
FIG. 12 is a cross-sectional view of a hinge system in accordance with exemplary aspects hereof.
Figure 13:
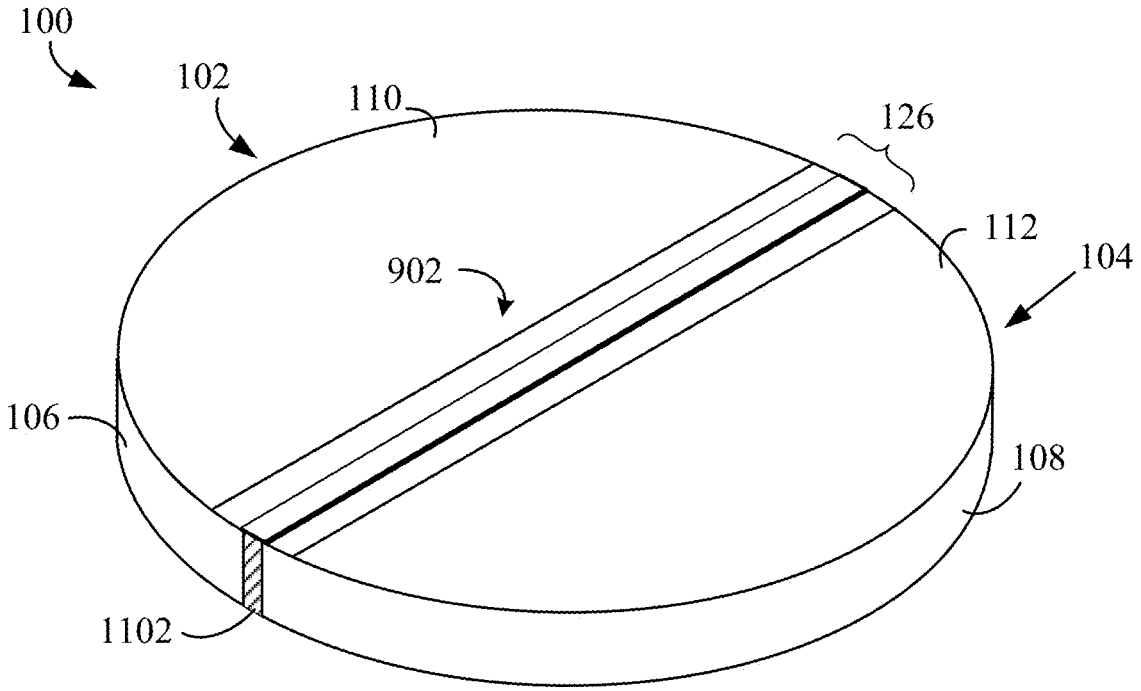
FIG. 13 is a perspective view of a pad with a hinge, in accordance with exemplary aspects hereof.
Figure 14:
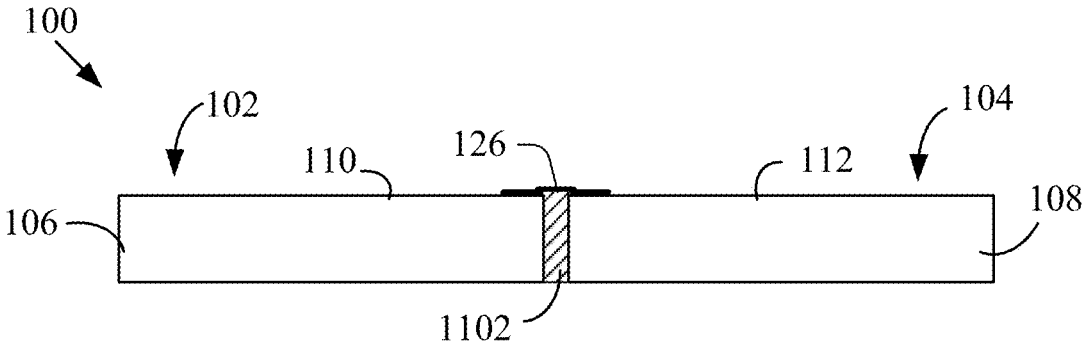
FIG. 14 is a cross-sectional view of a hinge system in accordance with exemplary aspects hereof.

As shown at FIGS. 11-14, the shape of the jig 1102 can vary in the embodiments. For instance, as shown at FIGS. 11 and 12, the top of the jig 1102 may have a rounded, curved, or peaked shape. The rounded, curved, or peaked shape can help to form the hinge 126 to have a desired width and/or a desired contour. As shown at FIGS. 13 and 14, the top of the jig 1102 may have a more flat or polygonal shape, and may have a height that is greater than the height of the pad portions 102, 104. The height of the jig 1102 can help to form the hinge 126 to have a raised middle section, also to provide the desired width and/or contour. Accordingly, the jig 1102 can have other shapes and sizes to accommodate a desired hinge 126.

Once the hinge material 134 and sealing coat(s) 902 (if present) have cured, the jig 1102 can be removed from between the first and second pad portions 102, 104. In some cases, the jig 1102 is removed in one or more pieces from between the pad portions (102, 104). For instance, the pad 100 can be partly folded in a "V"-shape or an "L"-shape, and the jig 1102 removed from between the pad portions (102, 104). In other cases, the jig 1102 can be washed out from between the pad portions (102, 104).

For example, in some embodiments, the jig 1102 is comprised of a material that is capable of dissolving in the presence of some liquids, such as water or a light solvent. In the embodiments, the jig 1102 can be dissolved from between the pad portions (102, 104) once the hinge 126 is formed. In some examples, the jig 1102 may be formed from alloys, minerals, textiles, paper, biodegradables, and so forth, that can dissolve when exposed to water or a light solvent. In some cases, the jig 1102 breaks apart into smaller pieces that can be easily washed away or otherwise removed. For the purposes of this disclosure, a light solvent is any solvent that is not capable of deforming, dissolving, or otherwise marring a polymer (e.g., vinegar, citric acid, bleach, alcohols, and the like). When the jig 1102 is removed and the pad 100 is deployed (in the open, flat state), any gap left behind from the jig 1102 can be filled and sealed (with a gasket, caulking, etc.). The final deployed state of the pad 100 comprises a unified pad 100 with a seamless and continuous moisture barrier along all surfaces. The hinge 126 pulls the pad portions (102, 104) together to further unify the pad 100. Because of the unified characteristic of the pad 100, it is not necessary during installation to separately level each independent portion (102, 104) of the pad 100, and there is little to no risk that the pad portions (102, 104) will shift after installation.

Figure 15:
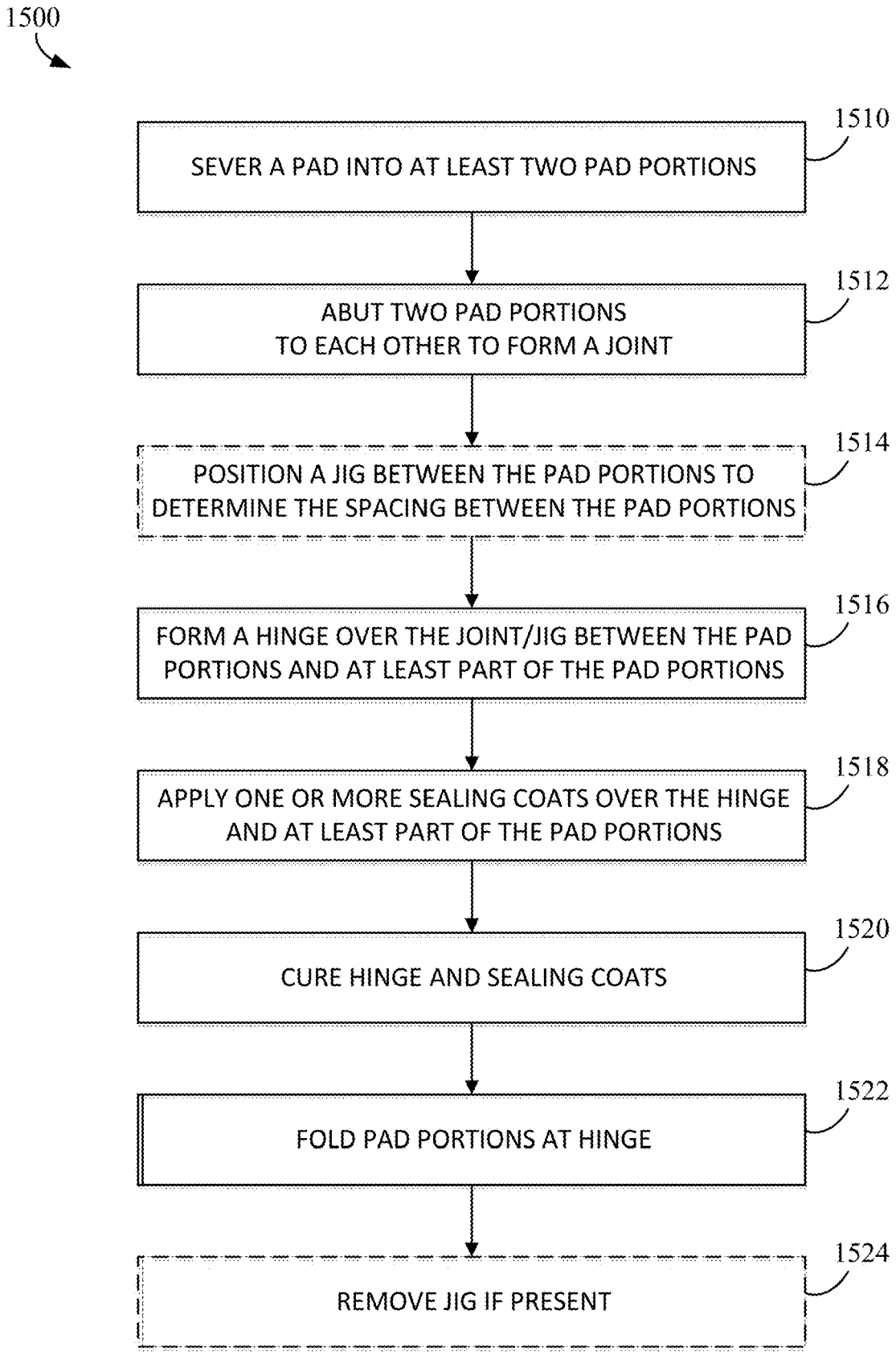
FIG. 15 shows a flow diagram including one or more processes relating to a hinge system, in accordance with exemplary aspects hereof.

Referring to FIG. 15, a flow diagram illustrates an example process 1500 for making the pads 100 shown at FIGS. 9-14. One or more of the process steps can be removed or adjusted while remaining within the scope of the disclosure. Further, the order of the process steps is not intended to be limiting, unless specifically indicated.

For example, as shown in FIG. 15, a pad 100 including hinge 126 can be made, in embodiments, in accordance with one or more exemplary steps. As shown at 1510, a support pad is severed into at least two pad portions. At 1512, two of the pad portions (such as first and second pad portions 102, 104) are aligned adjacent to each other and abutted against each other (along the severed edges of each pad, for example). In embodiments, three or more pad portions may be aligned or arranged in sequence to enable hinge systems in accordance with embodiments herein.

In an embodiment, the process includes the optional step 1514 of providing a jig (such as jig 1102) between the pad portions (102, 104) as a spacer to form the joint 114 between the pad portions (102, 104). In various examples, the jig 1102 is positioned between the first and second pad portions (102, 104), and the pad portions (102, 104) are tightly pressed against the jig 1102. The jig 1102, which may have a thickness of no more than ⅛ inch in some examples, holds the pad portions (102, 104) a predetermined distance apart while the hinge 126 is formed. The jig 1102 is comprised of a dissolvable material in some examples.

At 1516, a hinge (such as hinge 126, for example) comprising an elastomer such as polyurea (i.e., hinge material 134) is applied over the joint 114 between the pad portions (102, 104). The hinge 126 is formed on at least a part or section of the pad portions (102, 104). In an embodiment, the hinge 126 is formed by spraying, coating, or otherwise depositing hinge material, as described above, over the sections of the pad portions (102, 104), or over the whole of the pad portions (102, 104) and including the joint 114 and jig 1102 if present, to form a continuous hinge layer. In another embodiment, the process includes positioning a pre-formed hinge 126, comprising a section of a cured or partly-cured polymer, elastomer, or other suitable flexible material over the joint 114 and the jig 1102, if present, between the pad portions 102, 104. If present, the jig 1102 can shape the hinge 126 to conform to the shape of the jig 1102.

At 1518, the process includes applying (e.g., spraying, coating, painting, etc.) one or more sealing coats (such as sealing coat(s) 920, for example) over the hinge 126, to seal the hinge 126 in place. The one or more sealing coats 902 are also applied over some or all of each of the pad portions (102, 104), and may cover the entire pad 100, in some examples.

At 1520, the hinge material 134 and the one or more sealing coats 920 are allowed to cure. For example, in some cases the hinge material 134 and the sealing coats 920 cure for about 12 hours or, in some cases depending on temperature, less than 12 hours or for up to 72 hours or more.

At 1522, the pad 100 is folded at the hinge 126 and at 1524, the jig 1102 is removed if it was used. The jig 1102 may be removed by pulling the jig 1102 from its location, by cleaning the jig material from the joint 114, or in some cases by dissolving the jig 1102 using water or a light solvent (or any combination of the above). The process steps described herein can be combined or omitted in the course of producing embodiments of the present invention.

This discussion of exemplary advantages, features, and embodiments is illustrative only and is not intended to be limiting. Based on the disclosure, it will be understood that additional advantages are provided by aspects described herein.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure It will be understood that certain features and subcombinations are of utility and may be employed without reference to other features and subcombinations and are contemplated within the scope of the claims. Not all steps listed in the various figures need be carried out in the specific order described.

What is claimed is:

1. A hinge system comprising:

a support pad, comprising:

a first portion having a first edge; and a second portion having a second edge, the second edge abutted to the first edge and the second portion coupled to the first portion; and a polymer hinge, wherein a first part of the hinge is contiguous with a top surface of the first portion at a predetermined distance from the first edge, a second part of the hinge is discontiguous with the top surface of the first portion at the first edge, a third part of the hinge is contiguous with a top surface of the second portion at the predetermined distance from the second edge, and a fourth part of the hinge is discontiguous with the top surface of the second portion at the second edge, wherein the polymer hinge, the top surface of the first portion, and the top surface of the second portion comprise a planar, moisture-sealed surface.

2. The hinge system of claim 1, wherein the first edge of the first portion is aligned to the second edge of the second portion.

3. The hinge system of claim 2, wherein the polymer hinge is disposed over the first edge of the first portion and the second edge of the second portion.

4. The hinge system of claim 1, wherein the first portion is configured to be folded relative to the second portion via the polymer hinge.

5. A folding tank pad, comprising:

a support pad, comprising:

a first portion having a first top surface; and a second portion having a second top surface, the second portion severed from the first portion, a severed edge of the second portion being abutted to and coupled to a corresponding severed edge of the first portion; and an elastomer hinge, wherein a first part of the hinge is integral to or coupled to the first top surface a predetermined distance from the severed edge of the first portion, a second part of the hinge is integral to or coupled to the second top surface a predetermined distance from the severed edge of the second portion, and a third part of the elastomer hinge is disposed over the severed edge of the second portion and the severed edge of the first portion while remaining separated from the first top surface at the severed edge of the first portion and separated from the second top surface at the severed edge of the second portion, the elastomer hinge flexibly coupling the second portion to the first portion and forming a continuous moisture barrier between the first portion and the second portion.

6. The folding tank pad of claim 5, further comprising a sealing coat disposed over the elastomer hinge, sealing the elastomer hinge to the first portion and the second portion.

7. The folding tank pad of claim 5, wherein the first portion is inseparable from the second portion.

8. The folding tank pad of claim 5, wherein the elastomer hinge overlaps a part of the first portion and a part of the second portion.

9. The folding tank pad of claim 5, wherein the elastomer hinge is in tension when the first portion and the second portion are in an opened configuration.

10. The folding tank pad of claim 5, wherein the elastomer comprises a polyurea.

11. A method of forming a folding tank pad, comprising:

severing a tank pad into at least two pad portions;

abutting two severed pad portions of the at least two pad portions to each other and forming a joint where the two severed pad portions meet;

forming a flexible hinge over the joint and over at least part of each of the two severed pad portions, such that a first part of the hinge is contiguous with a top surface of a first pad portion a predetermined distance from the joint, a second part of the hinge is discontiguous with the top surface of the first pad portion and a top surface of a second pad portion at the joint, and a third part of the hinge is contiguous with the top surface of the second pad portion the predetermined distance from the joint;

applying one or more sealing coats over the hinge and over the at least part of each of the two severed pad portions; and folding the two severed pad portions at the hinge.

12. The method of forming a folding tank pad of claim 11, further comprising aligning a severed edge of each of the two severed pad portions to a severed edge of another of the two severed pad portions.

13. The method of forming a folding tank pad of claim 11, further comprising:

positioning a jig between the two severed pad portions; and removing the jig after curing the hinge and the one or more sealing coats.

14. The method of forming a folding tank pad of claim 13, further comprising contouring the hinge to conform to a shape of the jig.

15. The method of forming a folding tank pad of claim 13, wherein the jig is comprised of a dissolvable material.

16. The method of forming a folding tank pad of claim 13, further comprising dissolving the jig with water or a light solvent.

17. The method of forming a folding tank pad of claim 11, wherein each of the two severed pad portions is comprised of at least a base layer and a top layer over the base layer.

18. The method of forming a folding tank pad of claim 17, wherein the hinge comprises a same material as a material of the top layer.

19. The method of forming a folding tank pad of claim 17, wherein the one or more sealing coats comprises a same material as a material of the top layer.

20. The method of forming a folding tank pad of claim 11, further comprising:

abutting a third severed pad portion of the at least two pad portions to one of the two severed pad portions and forming a second joint where the third severed pad portion and the one of the two severed pad portions meet;

forming a second flexible hinge over the second joint and over at least part of each of the one of the two severed pad portions and the third severed pad portion;

applying one or more other sealing coats over the second hinge and the at least part of each of the one of the two severed pad portions and the third severed pad portion; and folding the one of the two severed pad portions and the third severed pad portion at the hinge.

* * * * *